US008917071B2

(12) United States Patent
Notani

(10) Patent No.: US 8,917,071 B2
(45) **Date of Patent: *Dec. 23, 2014**

(54) REGULATOR CIRCUIT

(71) Applicant: Renesas Electronics Corporation, Kawasaki-shi, Kanagawa (JP)

(72) Inventor: Hiromi Notani, Kanagawa (JP)

(73) Assignee: Renesas Electronics Corporation, Kawasaki-Shi, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/861,254

(22) Filed: Apr. 11, 2013

(65) Prior Publication Data

US 2013/0234689 A1 Sep. 12, 2013

Related U.S. Application Data

(63) Continuation of application No. 13/165,529, filed on Jun. 21, 2011, now Pat. No. 8,432,144.

(30) Foreign Application Priority Data

Jun. 21, 2010 (JP) ..... 2010-140449

(51) Int. Cl.
*G05F 1/40* (2006.01)
*G05F 3/02* (2006.01)

(52) U.S. Cl.
USPC ..... 323/280; 323/312; 327/538

(58) Field of Classification Search
USPC ..... 323/273–275, 280, 312–317; 327/538–543
See application file for complete search history.

(56) References Cited

U.S. PATENT DOCUMENTS 4,961,007 A 10/1990 Kumanoya et al.
6,194,887 B1 2/2001 Tsukada (Continued)

FOREIGN PATENT DOCUMENTS

JP H06-019565 A 1/1994
JP 08-190437 7/1996

(Continued)

OTHER PUBLICATIONS

Ishibashi, K., et al., "A Voltage Down Converter with Submicroampere Standby Current for Low-Power Static RAM's", IEEE Journal of Solid-State Circuits, Jun. 1992, pp. 920-926, vol. 27 No. 6, IEEE.

(Continued)

*Primary Examiner* — Jessica Han
(74) *Attorney, Agent, or Firm* — McDermott Will & Emery LLP

(57) ABSTRACT

There is provided a regulator circuit capable of increasing the capacity of the output transistor for supplying current, stably generating an internal power supply voltage and adapting to the reduction of a power supply voltage. The regulator circuit includes an output transistor which is supplied with an external power supply voltage and supplies dropped voltage to an internal circuit, a differential amplifier for outputting a gate potential applied to the gate of the output transistor, a reference voltage generating circuit for supplying a reference voltage to the differential amplifier, and a cut-off transistor for turning off the output transistor to stop supplying power to the internal circuit. The output transistor is comprised of a depression NMOS transistor whose threshold voltage is a negative voltage. The regulator circuit further includes substrate potential control means for controlling the substrate potential of the depression NMOS transistor.

4 Claims, 13 Drawing Sheets

(56) References Cited

U.S. PATENT DOCUMENTS

| | | | | |
|---|---|---|---|---|
| 6,198,258 | B1 * | 3/2001 | Ando et al. | 323/222 |
| 6,424,585 | B1 | 7/2002 | Ooishi | |
| 6,556,071 | B2 | 4/2003 | Notani et al. | |
| 6,801,033 | B2 | 10/2004 | Sudo et al. | |
| 8,432,144 | B2 * | 4/2013 | Notani | 323/280 |
| 2001/0011921 | A1 | 8/2001 | Ooishi | |
| 2002/0075066 | A1 | 6/2002 | Kuroda | |

FOREIGN PATENT DOCUMENTS

| | | |
|---|---|---|
| JP | 2000-148263 | 5/2000 |
| JP | 2001-034349 | 2/2001 |
| JP | 2002-343874 | 11/2002 |
| JP | 2005-258644 | 9/2005 |
| JP | 2006-134268 | 5/2006 |
| JP | 2008-192083 | 8/2008 |
| JP | 2009265955 A | 11/2009 |

OTHER PUBLICATIONS

Notification of Reasons for Refusal Japanese Patent Application No. JP 2010-140449 dated Jul. 15, 2014 with English language translation.

Japanese Notification of Reasons for Refusal issued in Japanese Application No. 2010-140449 dated Feb. 25, 2014, w/English abstract.

* cited by examiner

REGULATOR CIRCUIT

RELATED APPLICATIONS

This application is a Continuation of U.S. patent application Ser. No. 13/165,529, filed Jun. 21, 2011, now U.S. Pat. No. 8,432,144, which in turn claims the benefit of Japanese Application No. 2010-140449, filed on Jun. 21, 2010, the disclosures of which Applications are incorporated by reference herein in their entireties.

BACKGROUND

The present invention relates to a regulator circuit configured to convert a power supply voltage supplied from an input terminal and output the converted power supply voltage to an output terminal.

In recent years, the power consumption of a battery driver for an electronic appliance has tended to reduce and along with that a demand on the electronic appliance to operate in a low voltage has increased. The electronic appliance of this type includes a regulator circuit for generating an internal power supply voltage used in the internal circuit of the electronic appliance from an external power supply voltage supplied from the outside.

As a regulator circuit of this type, Patent Document 1 (Japanese Unexamined Patent Publication No. 2008-192083) discloses a regulator circuit which includes an output transistor for generating a predetermined output voltage according to an input voltage and an output voltage control means which compares a voltage in which the output voltage of the output transistor is divided with a predetermined reference voltage, controls the gate voltage of the output transistor so that the divided voltage becomes equal to the predetermined reference voltage, and sets a predetermined output voltage. Patent Document 1 uses a common-drain depression N-channel metal oxide semiconductor (NMOS) whose threshold voltage is a negative voltage as an output transistor to reduce a difference between the input and the output voltage, improving efficiency and allowing the regulator circuit to be used even if the input voltage from the outside is lowered.

Non-Patent Document 1: (Koichiro Ishibashi et al., "A Voltage Down Converter with Submicroampere Standby Current for Low-Power Static RAM's," IEEE Journal of Solid-State Circuits, Vol. 27, No. 6, June 1992) discloses a voltage follower including a differential amplifier and a depression NMOS transistor.

RELATED ART DOCUMENTS

Patent Documents

[Patent Document 1]
Japanese Unexamined Patent Publication No. 2008-192083
[Patent Document 2]
Japanese Unexamined Patent Publication No. Hei 08(1996)-190437
[Patent Document 3]
Japanese Unexamined Patent Publication No. 2006-134268
[Patent Document 4]
Japanese Unexamined Patent Publication No. 2001-34349
[Patent Document 5]
Japanese Unexamined Patent Publication No. 2000-148263
[Patent Document 6]
Japanese Unexamined Patent Publication No. 2005-258644
[Patent Document 7]
Japanese Unexamined Patent Publication No. 2002-343874

Non-Patent Document

[Non-Patent Document 1]
Koichiro Ishibashi et al., "A Voltage Down Converter with Submicroampere Standby Current for Low-Power Static RAM's," IEEE Journal of Solid-State Circuits, Vol. 27, No. 6, June 1992.

SUMMARY

In the regulator circuit described in the above patent document, however, if a ground potential is applied to the substrate of the depression NMOS transistor configuring the output transistor, the output voltage of a source potential is higher than the ground potential, so that the NMOS transistor is brought into a state where the substrate is reversely biased. In general, if the substrate of the NMOS transistor is reversely biased, the threshold voltage is increased by a substrate effect. For this reason, the regulator circuit described in the patent document has a problem in that the threshold voltage is increased to reduce the current of the NMOS transistor, decreasing the capacity of the NMOS transistor for supplying current.

In order to avoid such a problem, the level of a voltage (an external power supply voltage) input to the regulator circuit needs to be increased to ensure a desired current supply capacity. This imposes limitations on a tendency toward reduction in the external power supply voltage.

In the regulator circuit, a phase compensation capacitor comprised of an output transistor and a differential amplifier is provided to prevent the oscillation of a feedback loop (refer to Patent Documents 5 and 6, for example). The larger the capacity of the phase compensation capacitor, the higher the effect of suppressing oscillation. However, the larger the capacity, the larger a layout area to be required, which makes it difficult to realize the phase compensation capacitor in a semiconductor integrated circuit for electronic appliances of which a high integration is required.

In the regulator circuit, the output voltage immediately after a power supply is turned on is equal to the ground potential and greatly different from a desired voltage, so that a large current may flow into the output transistor to transfer a large energy from the input terminal to the output terminal. Such a large current flowing immediately after a power supply is turned on is referred to rush current. The flow of the rush current may damage the output transistor. Accordingly measures need to be taken to suppress the rush current.

The present invention has been made to solve these problems and has its object to provide a regulator circuit capable of increasing the capacity of the output transistor for supplying current, stably generating an internal power supply voltage and adapting to the reduction of a power supply voltage.

According to one aspect of the present invention, a regulator circuit converting a power supply voltage supplied from an input terminal and outputting the converted voltage to an output terminal includes a depression NMOS transistor coupled between the input and output terminals, a control circuit configured to compare the output voltage of the output terminal with a predetermined reference voltage and control the gate potential of the depression NMOS transistor according to the comparison result so that the output voltage agrees with the reference voltage, and substrate potential control means configured to turn on and off the depression NMOS transistor according to the output signal of the control circuit and control the substrate potential of the depression NMOS transistor to supply the amount of a desired current to the output terminal when the depression NMOS transistor is turned on.

According to the present invention, any potential can be applied to the substrate of the depression NMOS transistor configuring the output transistor, allowing increasing the capacity of the depression NMOS transistor for supplying current by decreasing the influence of the substrate effect on the threshold voltage. This can realize a regulator circuit capable of adapting to the reduction of the power supply voltage.

DETAILED DESCRIPTION

Figure 1:
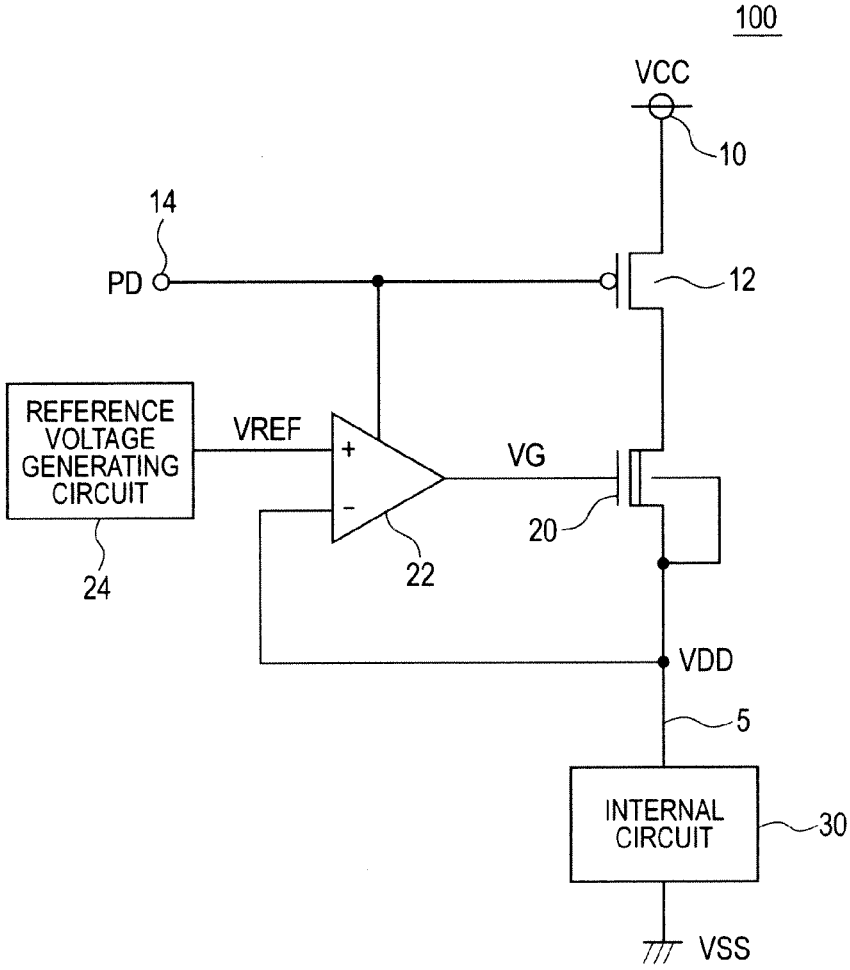
FIG. 1 is a circuit diagram illustrating an example of a configuration of a regulator circuit related to a first embodiment of the present invention.

The embodiments of the present invention are described below with reference to the accompanying drawings. The same reference numerals and characters in drawings are given to the same or corresponding parts and the description thereof is omitted.

First Embodiment

FIG. 1 is a circuit diagram illustrating an example of a configuration of a regulator circuit related to the first embodiment of the present invention.

Referring to FIG. 1, a regulator circuit 100 related to the first embodiment of the present invention is a step-down power supply circuit which is mounted on a semiconductor integrated circuit such as a semiconductor storage device and lowers a power supply voltage supplied from the outside (also referred to as external power supply voltage) to generate an internal power supply voltage VDD. The internal power supply voltage VDD generated by the regulator circuit 100 is supplied to an internal circuit 30 of the semiconductor integrated circuit as a load.

The regulator circuit 100 is supplied with the external power supply voltage VCC and includes an output transistor 20 for supplying a step-down voltage to an internal circuit 30, a differential amplifier 22 for outputting a gate potential VG applied to the gate of the output transistor 20, a reference voltage generating circuit 24 for supplying a reference voltage VREF being a predetermined constant voltage to the differential amplifier 22, and a cut-off transistor 12 for turning off the output transistor 20 to stop supplying the power to the internal circuit 30.

The output transistor 20 includes a depression N-channel metal oxide semiconductor (NMOS) whose threshold voltage is a negative voltage. The drain of the depression NMOS transistor 20 is coupled to a power supply terminal 10 via the cut-off transistor 12 and the source thereof is coupled to an internal power supply line 5 for supplying the internal power supply voltage VDD to the internal circuit 30. The voltage (the internal power supply voltage VDD) output from the source of the depression NMOS transistor 20 to the internal power supply line 5 is fed back to an inversion input terminal of the differential amplifier 22.

The differential amplifier 22 compares the reference voltage VREF input to a non-inversion input terminal with the output voltage VDD fed back to the inversion input terminal to control a gate potential VG of the depression NMOS transistor 20. More specifically, increase in load current consumed in the internal circuit 30 lowers the internal power supply voltage VDD. The output voltage (the internal power supply voltage) VDD starts being lower than the reference voltage VREF to increase the potential (gate potential) VG of output terminal of the differential amplifier 22, so that the gate-source voltage VGS of the depression NMOS transistor 20 to which the gate potential VG is applied increases. The gate-source voltage VGS increases the capacity of the depression NMOS transistor 20 for supplying current to increase the potential of the output voltage VDD.

On the other hand, the output voltage VDD starts being higher than the reference voltage VREF to lower the potential VG of output terminal of the differential amplifier 22, so that the gate-source voltage VGS of the depression NMOS transistor 20 to which the gate potential VG is applied lowers. This decreases or stops the supply of current from the depression NMOS transistor 20. Thus, the internal power supply voltage VDD is set to the reference voltage VREF.

In such a configuration, the depression NMOS transistor is used as the output transistor 20 to cause the gate potential VG to exceed VDD−Vth (−Vth refers to the threshold voltage of the depression NMOS transistor), allowing the gate potential VG to be equal to or smaller than the output voltage VDD. Thereby, the input voltage VCC can be lowered to a voltage almost equal to the output voltage VDD, allowing adapting to the decrease of the external power supply voltage VCC.

On the other hand, since the depression NMOS transistor is not turned off even if the gate potential VG and the source potential are lowered to the ground potential VSS, the output voltage VDD of the regulator circuit cannot be turned off.

In the regulator circuit 100 according to the first embodiment of the present invention, the cut-off transistor 12 is provided between the power supply terminal 10 and the drain of the depression NMOS transistor 20 being the output transistor. The cut-off transistor 12 is comprised of an enhancement P-channel Metal Oxide Semiconductor (PMOS) transistor.

The gate of the PMOS transistor 12 is coupled to a control terminal 14 to which a power-down control signal PD output from a control circuit (not shown) is applied. The power-down control signal PD is the one which shows a level "H" in a normal mode and is activated to a level "L" in a standby mode. For this reason, the power-down control signal PD with a level "L" is applied to the gate in the standby mode of the semiconductor integrated circuit to turn off the PMOS transistor 12. This electrically cuts off the power supply terminal 10 from the output transistor 20 to turn off the output transistor 20.

In a case where the ground potential VSS is applied to the substrate, the source potential VDD is higher than the ground potential VSS, so that the depression NMOS transistor is brought into a state where the substrate is reversely biased. In general, if the substrate of the NMOS transistor is reversely biased, the threshold voltage is increased by a substrate effect. The threshold voltage is increased to reduce the current of the NMOS transistor, decreasing the capacity of the NMOS transistor for supplying current.

In order to avoid such a problem, as shown in FIG. 1, the same potential as the source potential VDD is applied to the substrate of the depression NMOS transistor 20. The potentials of the substrate and the source are equal to each other to take a bias applied to the substrate as 0 V, allowing the substrate effect to be eliminated. This enables minimizing of decrease in the capacity of the depression NMOS transistor for supplying current.

Since decrease in the current supply capacity can be minimized, the lower limit value of the external power supply voltage VCC which needs to be applied to the regulator circuit 100 to realize a desired current supply capacity can be lowered. This allows adapting to the decrease of the external power supply voltage VCC.

[Modification 1]

Figure 2:
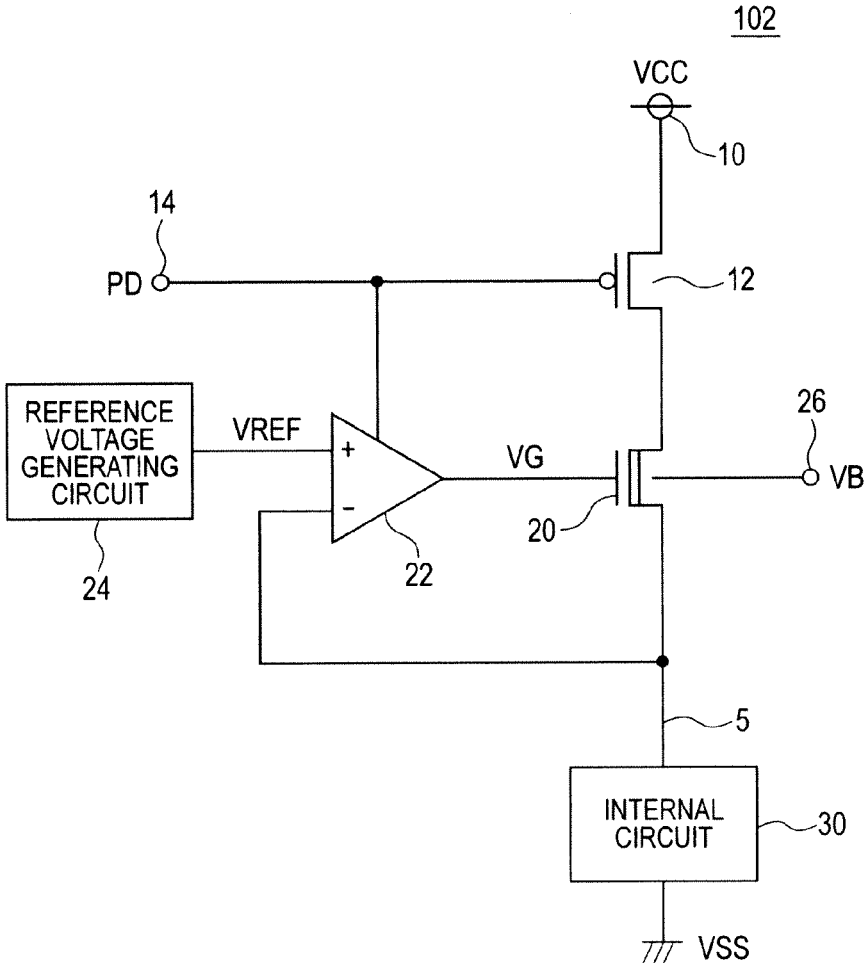
FIG. 2 is a circuit diagram illustrating an example of a configuration of a regulator circuit according to a modification 1 of the first embodiment of the present invention.

FIG. 2 is a circuit diagram illustrating an example of a configuration of a regulator circuit 102 according to a modification 1 of the first embodiment of the present invention.

Referring to FIG. 2, the regulator circuit 102 according to the modification 1 is different from the regulator circuit 100 illustrated in FIG. 1 in that any potential can be applied to the substrate of the depression NMOS transistor 20 being the output transistor.

More specifically, the substrate of the depression NMOS transistor 20 is coupled to an input terminal 26 and potential is applied thereto via the input terminal 26. The regulator circuit 102 according to the modification 1 is configured such that the potential of substrate of the depression NMOS transistor 20 can be adjusted by the potential applied to the input terminal 26. In the regulator circuit 102 according to the modification 1, such a configuration minimizes decrease in the capacity of the depression NMOS transistor for supplying current and surely turns off the depression NMOS transistor 20 when the potential (gate potential) VG of output terminal of the differential amplifier 22 is lowered, i.e., when the signal output by the differential amplifier 22 is deactivated.

More specifically, we suppose the case where the threshold voltage of the depression NMOS transistor 20 disperses in a deeper direction due to process dispersion. In this case, as described in FIG. 1, the configuration in which the potential of the substrate is fixed equal to that of the source causes a problem that the depression NMOS transistor 20 is not turned off even when the potential (gate potential) VG of output terminal of the differential amplifier 22 is lowered to reach the lower limit (the ground potential VSS, for example) because the threshold voltage−Vth is lower than the gate-source voltage VGS (=VSS−VDD) of the depression NMOS transistor 20 supplied with the VSS. For this reason, the output voltage (internal power supply voltage) VDD needs to be kept at the reference voltage VREF in a retention mode in which the consumption current of the internal circuit 30 is small, however, the output voltage VDD exceeds a desired reference voltage VREF because the regulator circuit continuously supplies current.

On the other hand, in the regulator circuit 102 according to the modification 1, any potential can be applied to the substrate of the depression NMOS transistor 20 via the input terminal 26 within the voltage higher than the ground potential VSS and lower than the source potential VDD (VSS<VB<VDD). The potential of substrate of the depression NMOS transistor 20 is adjusted to allow adjustment of the threshold voltage of the depression NMOS transistor 20 using the substrate effect.

In the modification 1, the potential of the substrate is set to surely turn off the depression NMOS transistor 20 supplied with the lower limit (the ground potential VSS) of the potential of output terminal of the differential amplifier 22 in consideration of dispersion of the threshold voltage in the depression NMOS transistor 20. This cuts off the current supplied from the regulator circuit 102 in the retention mode to enable the current output voltage VDD to be maintained at a desired voltage level.

In the regulator circuit 102 according to the modification 1, the potential is applied from the outside of the regulator circuit 102 to the substrate of the depression NMOS transistor 20 via the input terminal 26. As a specific example, the potential generated by a reference potential circuit (a band gap reference circuit, for example) included in a semiconductor integrated circuit on which the regulator circuit 102 is mounted may be applied to the input terminal 26.

[Modification 2]

Figure 3:
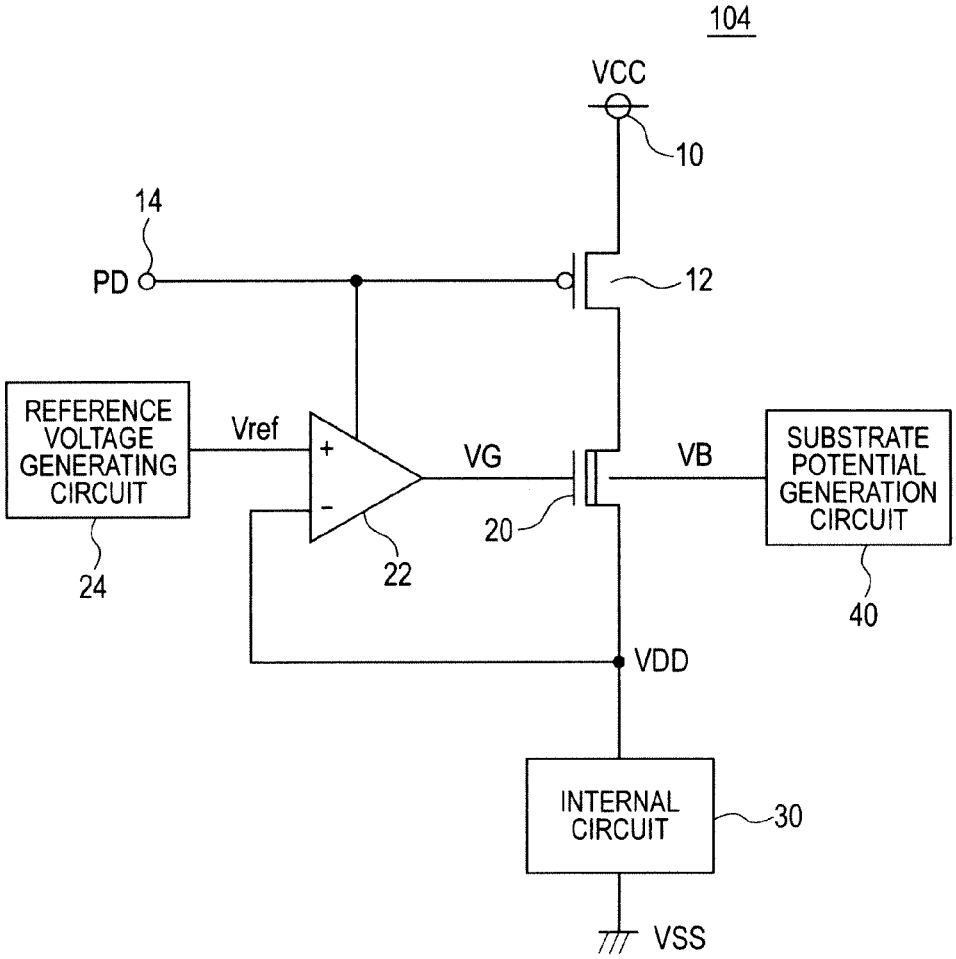
FIG. 3 is a circuit diagram illustrating an example of a configuration of a regulator circuit according to a modification 2 of the first embodiment of the present invention.

FIG. 3 is a circuit diagram illustrating an example of a configuration of a regulator circuit 104 according to a modification 2 of the first embodiment of the present invention.

Referring to FIG. 3, the regulator circuit 104 according to the modification 2 is different from the regulator circuit 102 illustrated in FIG. 2 in that the regulator circuit 104 is provided with a substrate potential generation circuit 40 instead of the input terminal 26 for applying the potential to the substrate of the depression NMOS transistor 20. In other words, the regulator circuit 104 according to the modification 2 is capable of applying any potential generated by the substrate potential generation circuit 40 to the substrate of the depression NMOS transistor 20.

As is the case with the regulator circuit 102 according to the above modification 1, also in the regulator circuit 104 according to the modification 2, such a potential that the depression NMOS transistor 20 supplied with the lower limit (the ground potential VSS) of the potential of output terminal of the differential amplifier 22 is surely turned off can be applied to the substrate of the depression NMOS transistor 20. This can maintain the current output voltage VDD at a desired voltage level in the retention mode.

An example of configuration of the substrate potential generation circuit 40 is described below with reference to the drawing. FIGS. 4A to 4D show a configuration of circuits for generating a substrate potential with the ground potential VSS as a reference. FIGS. 5A to 5H and FIGS. 6I to 6L show a configuration of circuits for generating a substrate potential with the reference voltage VREF as a reference.

Figure 4A:
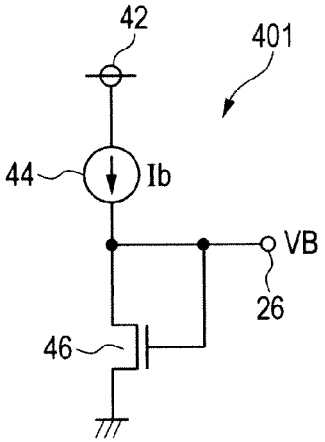
FIGS. 4A to 4D are circuit diagrams illustrating an example of a configuration of a substrate potential generation circuit for generating substrate potential with ground potential as a reference.

Referring to FIG. 4A, a substrate potential generation circuit 401 includes a constant current source 44 coupled in series between a power supply terminal 42 and the ground potential VSS and a diode-coupled NMOS transistor 46 whose gate and drain are coupled to each other. When a certain amount of bias current Ib flows into the constant current source 44, the diode-coupled NMOS transistor 46 converts the bias current Ib into a potential VB. The potential VB to which the bias current Ib is converted is applied to the substrate of the depression NMOS transistor 20 via the input terminal 26.

Figure 4B:
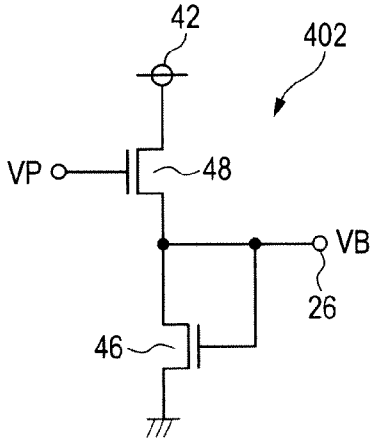

In a substrate potential generation circuit 402 shown in FIG. 4B, a PMOS transistor 48 coupled between the power supply terminal 42 and the NMOS transistor 46 functions as a constant current source. More specifically, the PMOS transistor 48, to the gate of which a gate potential VP generated by a bias circuit (not shown) is applied, causes a current equal in magnitude to the bias current Ib to flow. The NMOS transistor 46 converts the current into the potential VB.

Figure 4C:
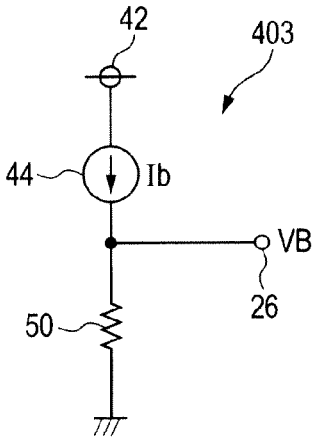
Figure 4D:
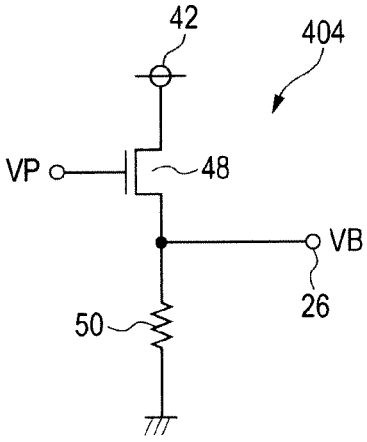

A substrate potential generation circuit 403 shown in FIG. 4C is different from the substrate potential generation circuit 401 shown in FIG. 4A in that the substrate potential generation circuit 403 includes a resistor 50 instead of the diode-coupled NMOS transistor 46. A substrate potential generation circuit 404 shown in FIG. 4D is different from the substrate potential generation circuit 402 shown in FIG. 4B in that the substrate potential generation circuit 404 includes the resistor 50 instead of the diode-coupled NMOS transistor 46. In the substrate potential generation circuits 403 and 404, a current equal in magnitude to the bias current Ib flowing into the constant current source 44 or the PMOS transistor 48 flows in the resistor 50 to generate the potential VB equal to the product of the bias current Ib and the resistor 50 on the input terminal 26. The generated potential VB is applied to the substrate of the depression NMOS transistor 20.

As described above, in the substrate potential generation circuits 401 and 402, the level of the substrate potential VB is determined by the gate potential of the NMOS transistor 46 required to cause a constant current determined by the bias current Ib or the gate potential VP to flow into the PMOS transistor 48. In the substrate potential generation circuits 403 and 404, the level of the substrate potential VB is determined by a potential drop occurring when a constant current flowing into the PMOS transistor 48 determined by the bias current Ib or the gate potential VP flows into the resistor 50. Thus, the potential VB generated by the substrate potential generation circuits 401 to 404 is generated with the ground potential VSS as a reference, so that the input voltage (the external power supply voltage) VCC independency can be reduced.

FIGS. 5A to 5H and FIGS. 6I to 6L show substrate potential generation circuits 411 to 422 configured to generate a substrate potential with the reference voltage VREF as a reference.

Figure 5A:
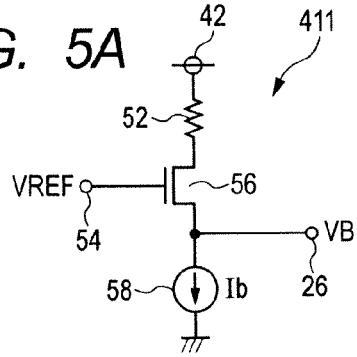
FIGS. 5A to 5H are circuit diagrams illustrating an example of a configuration of a substrate potential generation circuit for generating substrate potential with ground potential as a reference.

Referring to FIG. 5A, a substrate potential generation circuit 411 includes a resistor 52, an NMOS transistor 56, and a constant current source 58 coupled in series between the power supply terminal 42 and the ground potential VSS. The gate of the NMOS transistor 56 is coupled to the input terminal 54 of the reference voltage VREF and the node between the NMOS transistor 56 and the constant current source 58 is coupled to the input terminal 26 of the potential VB. In such a configuration, when the NMOS transistor 56, to the gate of which the reference voltage VREF is applied, is turned on, a current equal in magnitude to the bias current Ib flowing into the constant current source 58 flows in the resistor 52. This generates the potential VB dropped from the power supply voltage by a potential equal to the product of the bias current Ib and the resistor 52 on the input terminal 26.

Figure 5B:
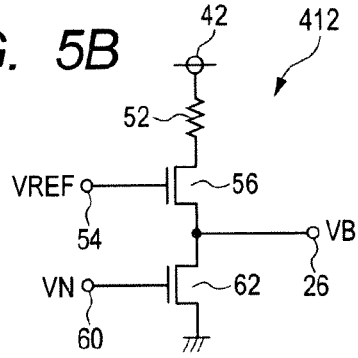

In a substrate potential generation circuit 412 shown in FIG. 5B, a NMOS transistor 62 coupled between the NMOS transistor 56 and the ground potential VSS functions as a constant current source. More specifically, the NMOS transistor 62, to the gate of which a gate potential VN generated by a bias circuit (not shown) is applied, causes a current equal in magnitude to the bias current Ib to flow.

Figure 5C:
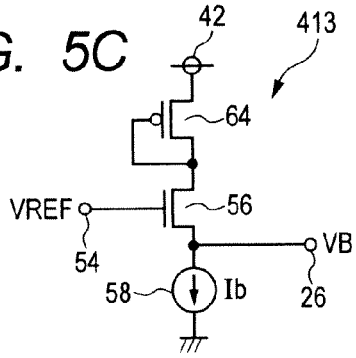
Figure 5D:
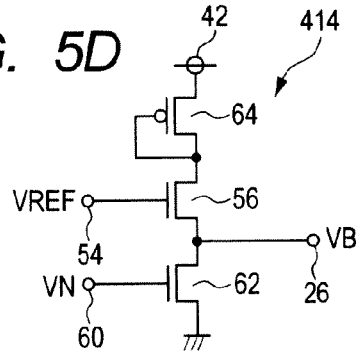

Substrate potential generation circuits 413 and 414 shown in FIGS. 5C and 5D respectively are different from the substrate potential generation circuits 411 and 412 in that each of the substrate potential generation circuits 413 and 414 includes a diode-coupled PMOS transistor 64 whose gate and drain are coupled to each other instead of the resistor 52. The PMOS transistor 64 converts the bias current Ib into a potential.

As described above, in the substrate potential generation circuits 411 and 414, the level of the substrate potential VB is determined by the gate-source voltage VGS of the NMOS transistor 56 required to cause a constant current determined by the bias current Ib or the gate potential VN to flow into the NMOS transistor 62. The substrate potential VB is determined by subtracting the gate-source voltage VGS of the NMOS transistor 56 from the reference voltage VREF, so that the input voltage (the external power supply voltage) VCC independency of the generated substrate potential VB is small.

Figure 5E:
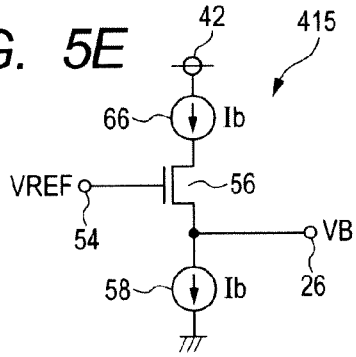

A substrate potential generation circuit 415 shown in FIG. 5E is different from the substrate potential generation circuit 411 shown in FIG. 5A in that the substrate potential generation circuit 415 includes a constant current source 66 instead of the resistor 52. In the configuration in FIG. 5E, the level of the substrate potential VB is determined by the gate-source voltage VGS of the NMOS transistor 56 required to cause the bias current Ib to flow into the constant current sources 58 and 66. The substrate potential VB is determined by subtracting the gate-source voltage VGS from the reference voltage VREF.

Figure 5F:
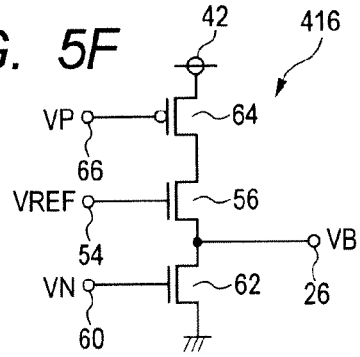

A substrate potential generation circuit 416 shown in FIG. 5F includes a PMOS transistor 64 and an NMOS transistor 62 instead of the constant current sources 66 and 58 shown in FIG. 5E respectively. The PMOS transistor 64, to the gate of which a gate potential VP generated by a bias circuit (not shown) is applied, causes a certain amount of current to flow. The NMOS transistor 62, to the gate of which a gate potential VN generated by a bias circuit (not shown) is applied, causes a current equal in magnitude to a current flowing into the PMOS transistor 64 to flow. For this reason, in FIG. 5F, the level of the substrate potential VB is determined by the gate-source voltage VGS of the NMOS transistor 56 required to cause a constant current to flow into the PMOS transistor 64 and the NMOS transistor 62. The substrate potential VB is determined by subtracting the gate-source voltage VGS from the reference voltage VREF.

Figure 5G:
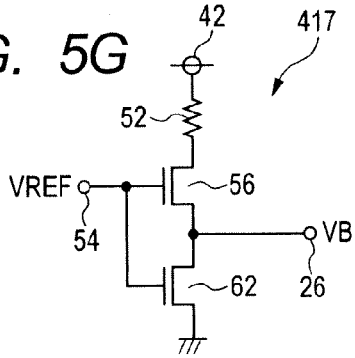
Figure 5H:
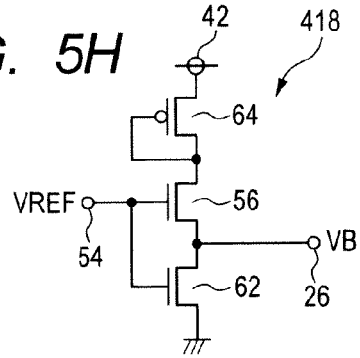

Substrate potential generation circuits 417 and 418 shown in FIGS. 5G and 5H include a resistor 52 or a diode-coupled PMOS transistor 64 respectively which functions as a constant current source and the NMOS transistors 56 and 62 which are coupled in series between the constant current source and the ground potential VSS.

The reference voltage VREF is applied to the gates of the NMOS transistors 56 and 62. The NMOS transistor 62 near the ground potential side is configured to be smaller in size than the NMOS transistor 56. Thereby, the current driving force of the NMOS transistor 62 is made smaller than that of the NMOS transistor 56. By such a configuration, the level of the substrate potential VB is determined by a difference between the gate source voltages VGS of two NMOS transistors 56 and 62 in the substrate potential generation circuits 417 and 418.

Referring to FIG. 6, the substrate potential generation circuits 419 to 422 are configured to generate a substrate potential with the reference voltage VREF as a reference and include the resistor 52 (or the diode-coupled PMOS transistor 64) coupled in series between the power supply terminal 42 and the ground terminal, the NMOS transistor 56 to the gate of which the reference voltage VREF is applied, and the resistor 50 (or the diode-coupled NMOS transistor 46).

Figure 6I:
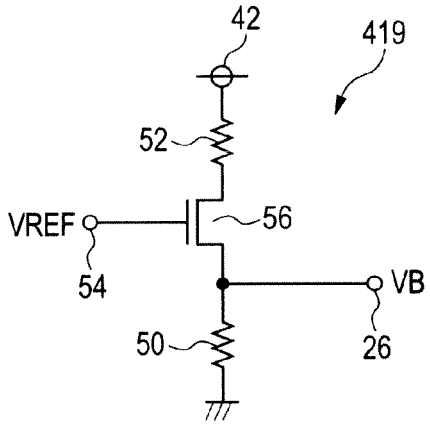
FIGS. 6I to 6L are circuit diagrams illustrating an example of a configuration of a substrate potential generation circuit for generating substrate potential with ground potential as a reference.
Figure 6J:
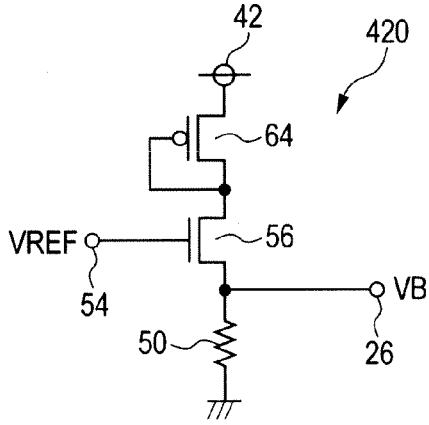
Figure 6K:
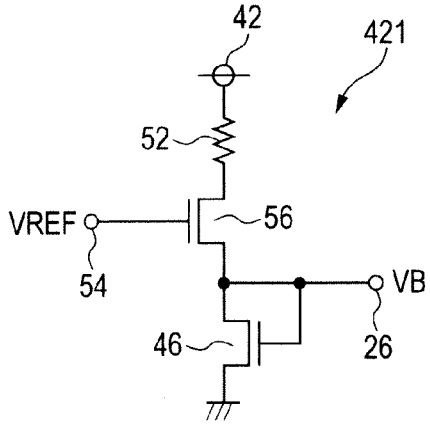
Figure 6L:
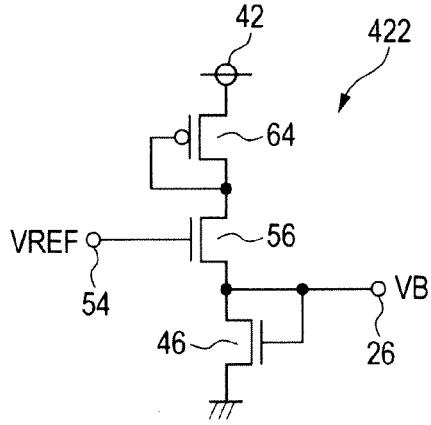

In the substrate potential generation circuits 419 and 420 shown in FIGS. 6I and 6J among them, the level of the substrate potential VB is determined by the ratio of the gate-source voltage VGS of the NMOS transistor 56 to the drop voltage in the resistor 50. In the substrate potential generation circuits 421 and 422 shown in FIGS. 6K and 6L, the level of the substrate potential VB is determined by the ratio of the gate-source voltage VGS of the NMOS transistor 56 to that of the diode-coupled NMOS transistor 46.

The configuration of the substrate potential generation circuits shown in FIGS. 4 to 6 is exemplary and not always limited thereto.

As described above, according to the first embodiment of the present invention, in the regulator circuit using the depression NMOS transistor as an output transistor, any potential can be applied to the substrate of the depression NMOS transistor. For that reason, the influence of the substrate effect on the threshold voltage is decreased to allow increasing the capacity of the depression NMOS transistor for supplying current. This permits adapting to the decrease of the external power supply voltage VCC. Since the depression NMOS transistor can be surely turned off in the retention mode, the output voltage (internal power supply voltage) of the regulator circuit can be maintained at a desired voltage level.

Second Embodiment

Figure 7:
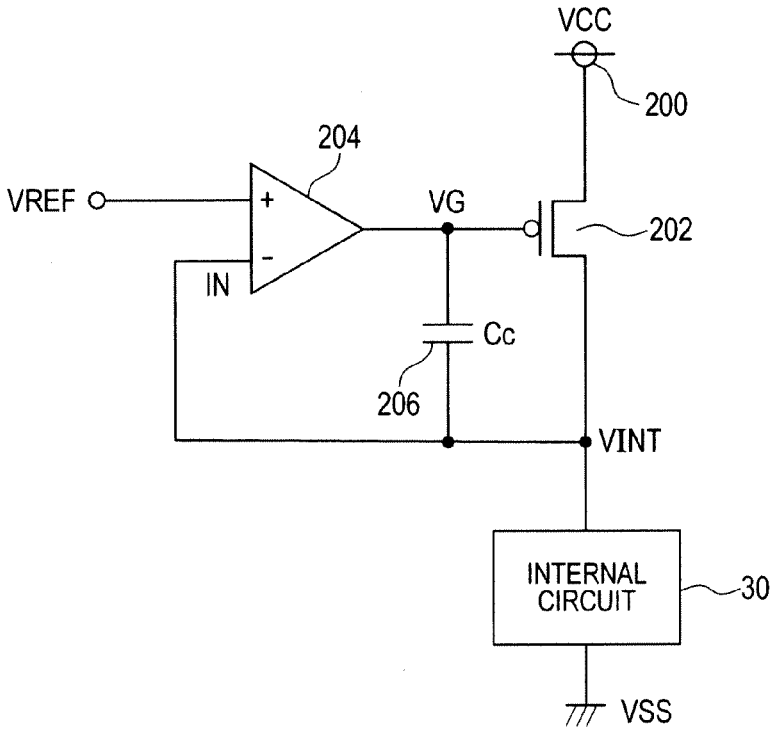
FIG. 7 is a circuit diagram describing an example of a configuration of a general regulator circuit.

FIG. 7 is a circuit diagram describing an example of a configuration of a general regulator circuit.

Referring to FIG. 7, the general regulator circuit includes a PMOS transistor 202 as an output transistor, a differential amplifier 204 for outputting a gate potential VG applied to the gate of the PMOS transistor 202, and a phase compensation capacitor 206. The phase compensation capacitor 206 is coupled between the gate and the drain of the PMOS transistor 202.

In the general regulator circuit shown in FIG. 7, when a very small amplitude signal with a low frequency is input to a non-inversion input terminal of the differential amplifier 204, a signal which has the same phase as an input signal IN and whose amplitude is amplified is output to the output terminal of the differential amplifier 204. The application of the signal to the gate of the PMOS transistor 202 causes the drain thereof to output a signal VINT whose polarity is reverse to the input signal.

The input signal IN with a high frequency delays the phase of the signal appearing on the output terminal of the differential amplifier 204 because the signal cannot follow the frequency of the input signal IN and becomes lower in gain than the input signal IN with a low frequency. Similarly, the output signal VINT also further delays in phase with respect to the output terminal and becomes lower in gain than the input signal IN with a low frequency. The input signal IN with a further high frequency further delays the phase of the output signal VINT. If a phase delays by 180 degrees and a gain is one time (if the total gain of the differential amplifier 204 and the PMOS transistor 202 is 0 dB), the regulator oscillates.

If the total gain of the differential amplifier 204 and the PMOS transistor 202 is 0 dB (the gain is one time) and the phase of the output signal VINT delays by −180 degrees or more with respect to the input signal IN, the regulator oscillates. If the phase of the output signal VINT advances by −180 degrees or more, the regulator does not oscillate. A difference between the phase at the total gain of 0 dB and −180 degrees is referred to as "phase margin." In general, the larger the phase margin, the harder the regulator is to oscillate.

A difference between the cutoff frequency of the differential amplifier 204 and the cutoff frequency of the output stage has only to be increased to increase the phase margin. Therefore, in the general regulator circuit, the cutoff frequency of the differential amplifier 204 is lowered to decrease the gain at a high frequency. More specifically, a phase compensation capacitor large in capacity is provided at the output to lower the cutoff frequency of the differential amplifier 204, increasing the phase margin to prevent oscillation.

However, the increase of capacity of the phase compensation capacitor requires a large layout area to make it difficult to increase the capacity in the semiconductor integrated circuit of which a high integration is required. For this reason, in the regulator circuit shown in FIG. 7, the phase compensation capacitor 206 is coupled between the gate and the drain of the PMOS transistor 202 being the output transistor to cause the Miller effect to increase the equivalent capacity of the phase compensation capacitor 206 to (1+A)Cc from a original capacity Cc.

More specifically, if the gain of the PMOS transistor 202 is taken as −A, and the amplitude of the signal input to the gate of the PMOS transistor 202 is taken as ΔV, the amplitude of the signal output to the drain of the PMOS transistor 202 is −AΔV. Accordingly, the voltage applied across the both ends of the phase compensation capacitor 206 is (1+A) ΔV. For this reason, the potential supplied to the phase compensation capacitor 206 is (1+A) CcΔV and the equivalent capacity of the phase compensation capacitor 206 is equal to (1+A) Cc.

Such a configuration enables reducing the capacity of the phase compensation capacitor to effectively provide phase compensation, allowing the prevention of increase in layout area of the semiconductor integrated circuit. Such a phase compensation is also referred to as "Miller compensation" and the equivalent capacity (1+A) Cc of the phase compensation capacitor 206 is also referred to as "Miller capacitance."

If such a Miller compensation is realized in the regulator circuit using the depression NMOS transistor as the output transistor, the gain of the source follower circuit comprised of the depression NMOS transistor is merely "1" at its maximum to cause a problem that the Miller compensation is not effective.

In the second embodiment of the present invention, a configuration for making the Miller compensation effective is described below with reference to the drawings also in the regulator circuit using the depression NMOS transistor.

Figure 8:
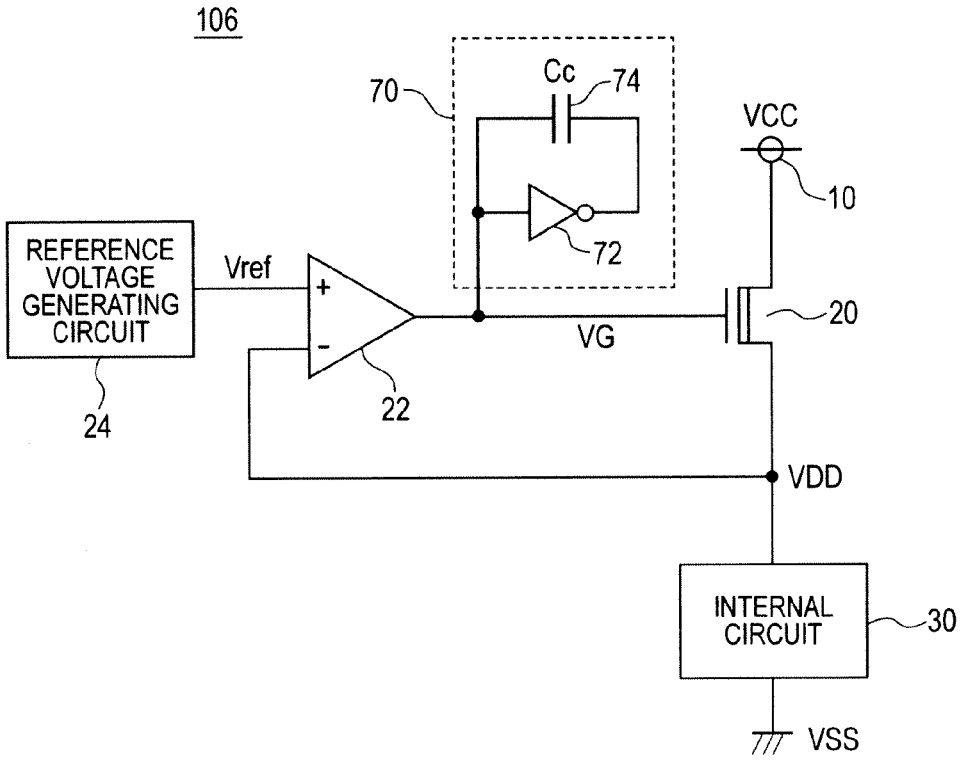
FIG. 8 is a circuit diagram describing an example of a configuration of a regulator circuit according to a second embodiment of the present invention.

FIG. 8 is a circuit diagram describing an example of a configuration of a regulator circuit 106 according to a second embodiment of the present invention.

Referring to FIG. 8, a regulator circuit 106 includes the depression NMOS transistor 20 being the output transistor, the differential amplifier 22 for outputting the gate potential VG applied to the gate of the depression NMOS transistor 20, the reference voltage generating circuit 24 for supplying the reference voltage VREF to the differential amplifier 22, and a phase compensation circuit 70 coupled to the output terminal of the differential amplifier 22.

The phase compensation circuit 70 includes an inverter 72 whose input terminal is coupled to the gate of the depression NMOS transistor 20 and a phase compensation capacitor 74 coupled between the output and input terminals of the inverter 72.

If the inverter 72 has a gain of "−A" and the amplitude of the signal input to the inverter 72 is ΔV, the amplitude of the signal output from the inverter 72 is −AΔV. Accordingly, the voltage applied across the both ends of the phase compensation capacitor 74 is (1+A) ΔV. For this reason, the potential supplied to the phase compensation capacitor 74 is (1+A) CcΔV and the equivalent capacity of the phase compensation capacitor 74 is equal to (1+A) Cc.

Thus, the phase compensation circuit 70 comprised of the inverter 72 and the phase compensation capacitor 74 is provided on the gate of the depression NMOS transistor 20 forming the source follower circuit to allow effectively providing the phase compensation in a small capacity as is the case with the general regulator circuit shown in FIG. 7.

An example of a configuration of the phase compensation circuit 70 in FIG. 8 is described with reference to the drawings. FIGS. 9A to 9F show examples of six types of phase compensation circuits 701 to 706. The phase compensation circuits 701 to 706 are classified into two groups: the phase compensation circuits 701 to 703 using the gain of an NMOS transistor 84; and the phase compensation circuits 704 to 706 using the gain of a PMOS transistor 88.

Figure 9A:
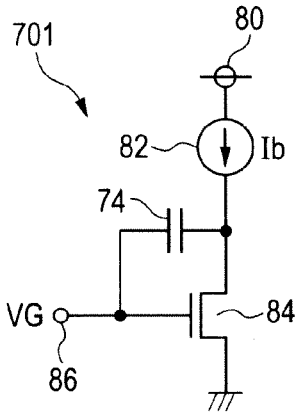
FIGS. 9A to 9F are circuit diagrams illustrating an example of a configuration of a phase compensation circuit.

Referring to FIG. 9A, the phase compensation circuit 701 includes a constant current source 82 and an NMOS transistor 84 which are coupled in series between a power supply terminal 80 and the ground potential. The gate of the NMOS transistor 84 is coupled to the output terminal 86 of the differential amplifier 22 (not shown). A phase compensation capacitor 74 is coupled between the gate and the drain of the NMOS transistor 84. On the other hand, in the phase compensation circuits 702 and 703 shown in FIGS. 9B and 9C, the PMOS transistor 88 and a resistor 90 instead of the constant current source 82 function as constant current sources.

Figure 9B:
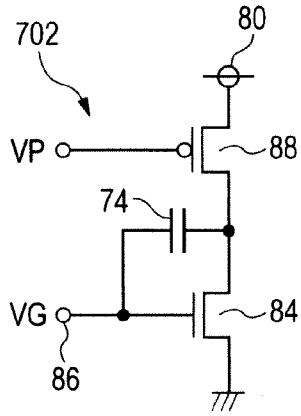
Figure 9C:
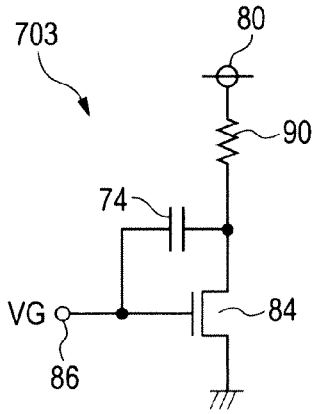
Figure 10:
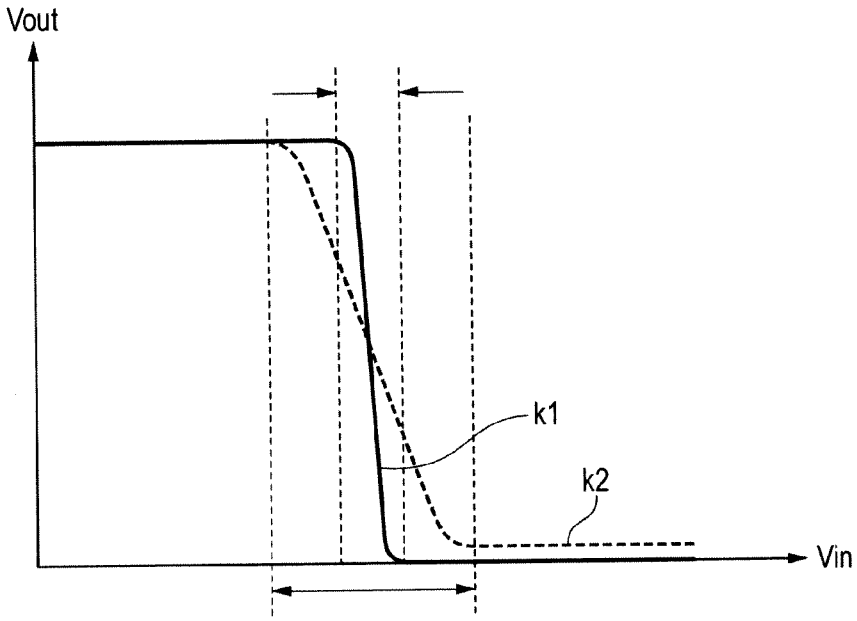
FIG. 10 shows the transfer characteristic of the inverter in FIG. 8.

The phase compensation circuits 701 to 703 shown in FIGS. 9A to 9C replace the PMOS transistor in the CMOS inverter circuit comprised of the PMOS transistor and the NMOS transistor as the inverter 72 (refer to FIG. 8) with a constant current source. Such a configuration can make wider the range of an input voltage in which a gain is increased than a case where the inverter 72 is comprised of the CMOS inverter circuit. FIG. 10 shows the transfer characteristic of the CMOS inverter circuit (corresponding to a curve k1 in the figure) and the transfer characteristic of the inverter with one transistor as the constant current source (corresponding to a curve k2 in the figure). Referring to FIG. 10, in the CMOS inverter circuit, an area where a gain is increased is limited to the range of voltage in the vicinity of a logic threshold. On the other hand, in the inverter with one transistor as the constant current source, the gain is lowered, but the area where a gain is increased can be taken as a wider range of voltage. Thereby, a more effective phase compensation can be provided.

Figure 9D:
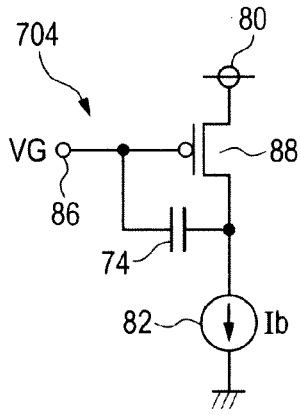
Figure 9E:
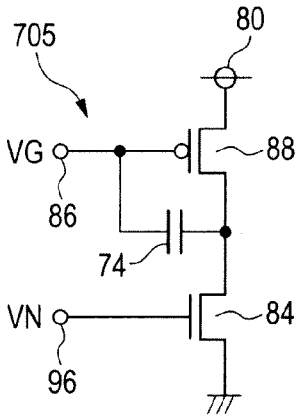
Figure 9F:
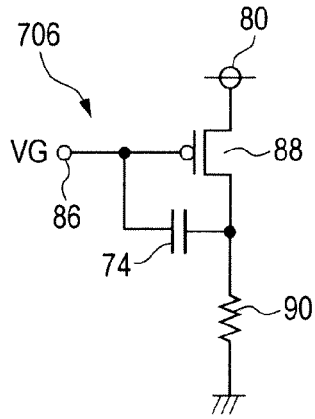

The phase compensation circuits 704 to 706 shown in FIGS. 9D to 9F replace the NMOS transistor in the CMOS inverter circuit as the inverter 72 (refer to FIG. 8) with a constant current source. In the configuration, the gate of the PMOS transistors 88 is coupled to the output terminal 86 of the differential amplifier 22 (not shown). The phase compensation capacitor 74 is coupled between the gate and the drain of the PMOS transistors 88. Also in phase compensation circuits 704 to 706, as is the case with the aforementioned phase compensation circuits 701 to 703, the area where a gain is increased can be extended, so that the phase compensation can be a more effectively provided than that in the configuration in which the CMOS inverter circuit is used.

[Modification]

Figure 11:
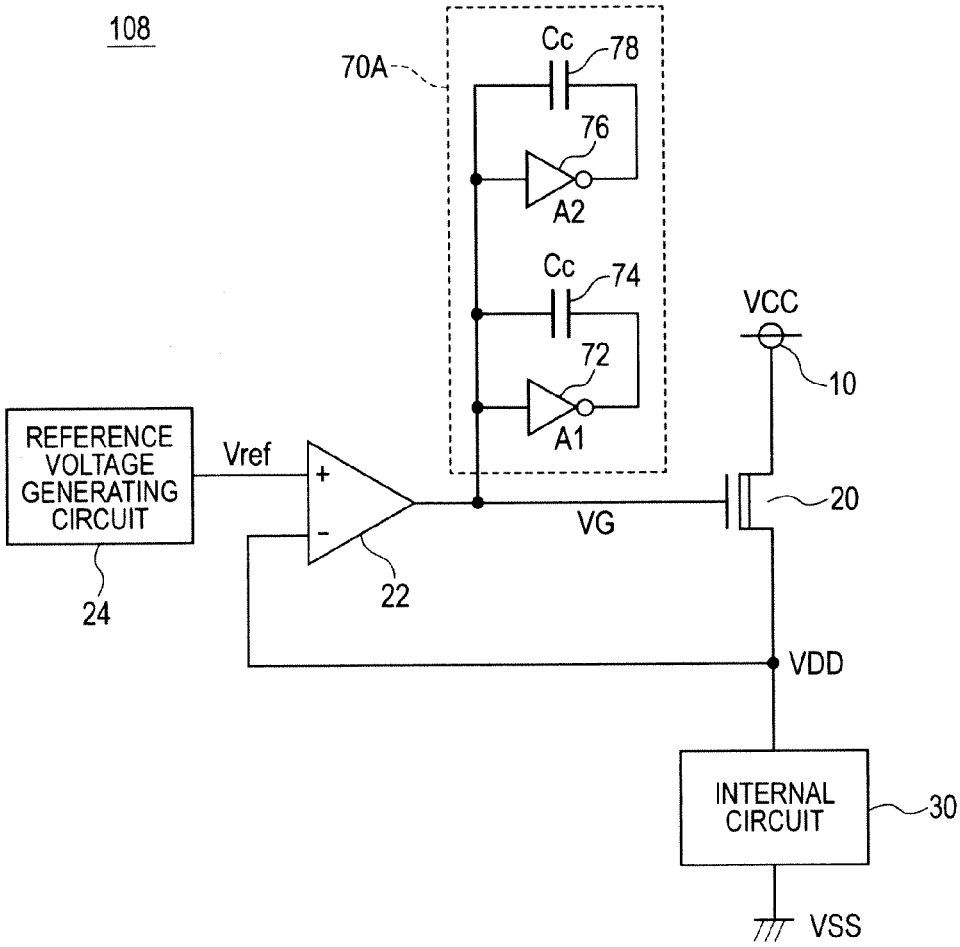
FIG. 11 is a circuit diagram illustrating an example of a configuration of a regulator circuit according to a modification of the second embodiment of the present invention.

FIG. 11 is a circuit diagram describing an example of a configuration of a regulator circuit 108 according to a modification of the second embodiment of the present invention.

Referring to FIG. 11, the regulator circuit 108 according to the modification is different from the regulator circuit 106 shown in FIG. 8 only in that the regulator circuit 108 is provided with a phase compensation circuit 70A instead of the phase compensation circuit 70.

In FIG. 11, the phase compensation circuit 70A includes a plurality of inverters 72 and 76 whose input terminals are coupled to the gate of the depression NMOS transistor 20 and the phase compensation capacitors 74 and 78 coupled between the output and input terminals of the inverters 72 and 76 respectively. Each of the inverter 72 and the phase compensation capacitor 74, and the inverter 72 and the phase compensation capacitor 78 includes any of the circuit configurations shown in FIGS. 9A to 9F.

Figure 12:
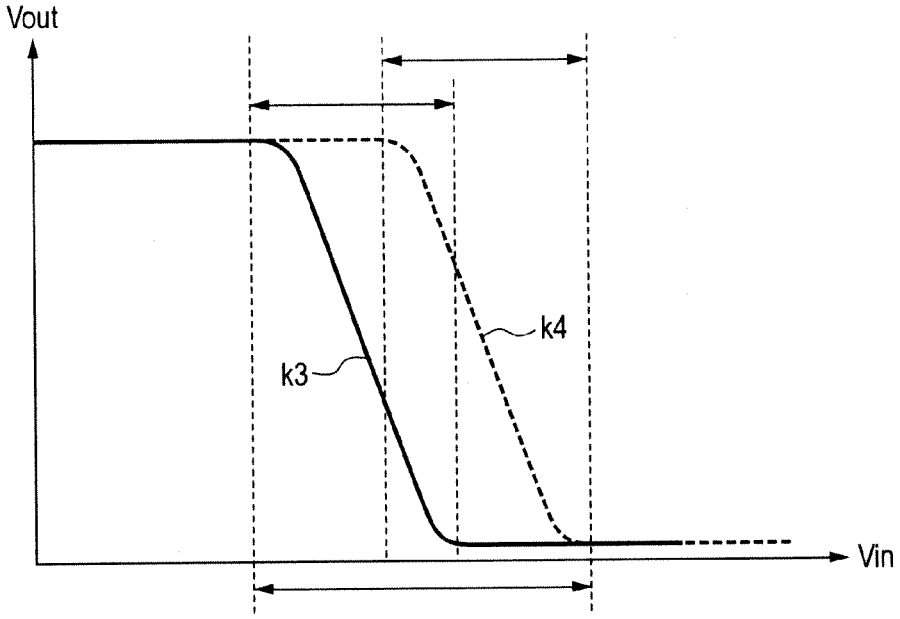
FIG. 12 shows the transfer characteristic of an inverter in FIG. 11.

In the above configuration, the inverters 72 and 76 are different in a logic threshold from each other. FIG. 12 shows the transfer characteristic of the inverter 72 (corresponding to a curve k3 in the figure) and the transfer characteristic of the inverter 76 (corresponding to a curve k4 in the figure). Referring to FIG. 12, the gain of each inverter is increased in the vicinity of the logic threshold, but the voltage range is different between the inverters 72 and 76. The total gain of the entire phase compensation circuit 70A is increased in the voltage range in which the voltage range of each inverter is superimposed. As a result, the area where the gain is increased can be further extended to allow effectively performing the phase compensation.

In the phase compensation circuit 70A in FIG. 11, if the inverter 72 has a gain of −A1 and the inverter 76 has a gain of −A2, the equivalent capacity of the phase compensation capacitor 74 is equal to (1+A1) Cc and the equivalent capacity of the phase compensation capacitor 78 is equal to (1+A2) Cc. Since the phase compensation capacitors 74 and 78 are coupled in parallel to the gate of the depression NMOS transistor 20, the Miller capacitance in the phase compensation circuit 70A is equal to (2+A1+A2) Cc being the sum of the equivalent capacity of the phase compensation capacitors 74 and 78. Accordingly, also in the configuration in which a plurality of the phase compensation capacitors is used, the capacitance of each capacitor can be reduced to permit preventing the increase of layout area of the semiconductor integrated circuit.

As described above, according to the second embodiment of the present invention, also in the regulator circuit using the depression NMOS transistor 20 as the output transistor, the capacitance of the phase compensation capacitor is reduced to enable effectively providing the phase compensation. As a result, the layout area of the semiconductor integrated circuit can be prevented from being increased.

Also in the foregoing regulator circuits 106 and 108 according to the second embodiment, as is the case with the regulator circuits 100, 102, and 104 according to the first embodiment, a cut-off transistor (PMOS transistor 12) may be provided between the power supply terminal 10 and the drain of the depression NMOS transistor 20. In the standby mode of the semiconductor integrated circuit, the cut-off transistor is turned off by the power-down control signal PD with a level "L" to allow the depression NMOS transistor 20 to be turned off.

Third Embodiment

In the regulator circuit, the output voltage VDD immediately after a power supply is turned on is equal to the ground potential VSS and greatly different from a desired voltage (the reference voltage VREF) For this reason, the regulator circuit causes a large current to flow via an output transistor to transfer a large energy from the input terminal to the output terminal. Such a large current flowing immediately after the power supply is turned on is also referred to rush current. The flow of the rush current may damage the output transistor.

To solve the above problem, Patent Document 7 (Japanese Unexamined Patent Publication No. 2002-343874) discloses a configuration in which, in a series regulator circuit using the PMOS transistor as the output transistor, a clamping circuit is coupled between the power supply terminal and the output terminal of the differential amplifier. A diode coupled in the forward direction is used as the clamping circuit. In such a configuration, a voltage (VCC−Vf) in which the threshold voltage Vf of the diode is subtracted from the input voltage (external power supply voltage) VCC is applied to the gate of the PMOS transistor immediately after the power supply is turned on. This turns on the PMOS transistor irrespective of the output of the differential amplifier.

Measures against such a rush current are required also for the regulator circuit using the depression NMOS transistor as the output transistor, however, the clamping circuit shown in Patent Document 7 cannot be applied as it is.

A configuration is studied in which a diode multistage coupling circuit that multistage diode-coupled NMOS transistors are coupled as the clamping circuit is coupled between the gate of the depression NMOS transistor and the ground potential VSS. In the normal operation at the internal power supply voltage VDD=1.5 V, the clamping voltage needs to be set so as to ensure the gate voltage capable of driving the maximum output current. If the clamping circuit is provided between the gate of the depression NMOS transistor and the ground potential VSS, the gate voltage is greater and the rush current is also greater at a low internal power supply voltage VDD than those in the normal operation.

In the third embodiment of the present invention, the clamping circuit is coupled between the gate and the source of the depression NMOS transistor instead of the above configuration. Thereby, the clamping circuit is provided between VG−VDD to allow VG−VDD to be clamped by the gate voltage almost equal to that in the normal operation even when internal power supply voltage VDD is low, permitting minimizing the rush current.

Figure 13:
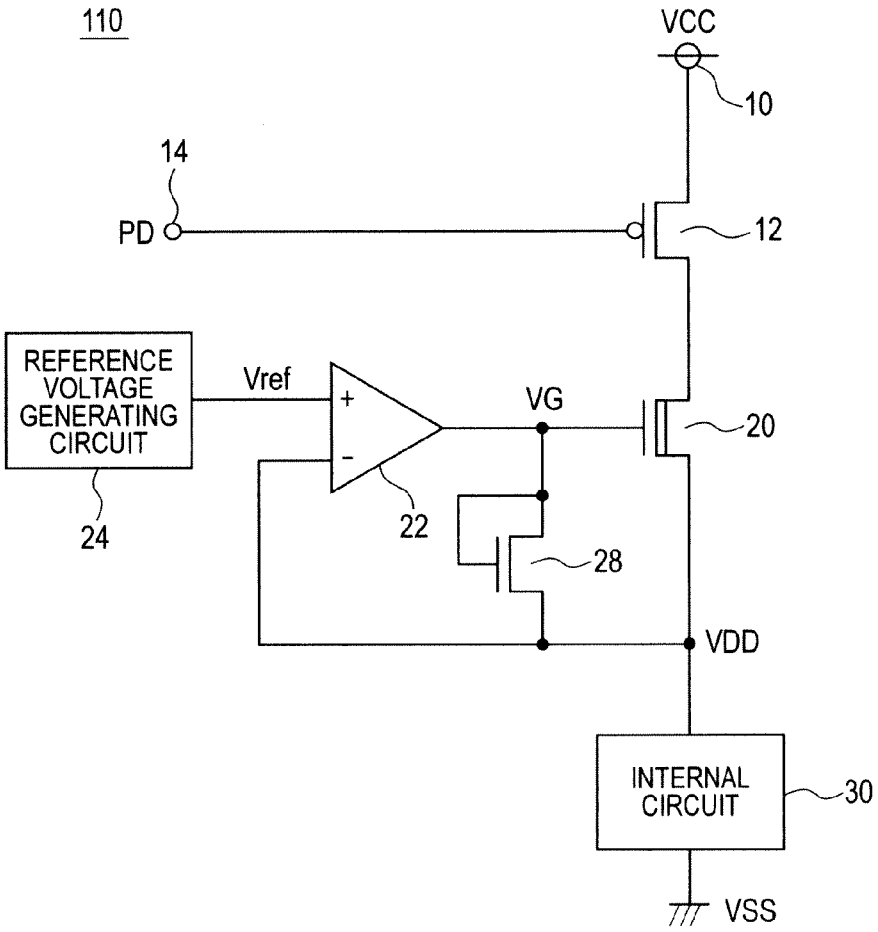
FIG. 13 is a circuit diagram describing an example of a configuration of a regulator circuit according to a third embodiment of the present invention.

FIG. 13 is a circuit diagram describing an example of a configuration of a regulator circuit 110 according to the third embodiment of the present invention.

Referring to FIG. 13, the regulator circuit 110 according to the third embodiment of the present invention includes the depression NMOS transistor 20 forming the output transistor, the differential amplifier 22 for outputting the gate potential VG applied to the gate of the depression NMOS transistor 20, the reference voltage generating circuit 24 for supplying the reference voltage VREF to the differential amplifier 22, and the PMOS transistor 12 forming the cut-off transistor.

The regulator circuit 110 includes a clamping circuit 28 coupled between the gate and the source of the depression NMOS transistor 20. The clamping circuit 28 is comprised of the diode-coupled NMOS transistor. Either the NMOS transistor or PMOS transistor may be used as the diode-coupled NMOS transistor used in the clamp circuit 28.

In the regulator circuit 110 shown in FIG. 13, the gate-source voltage VGS of the depression NMOS transistor 20 is clamped to a predetermined voltage according to the threshold voltage of the diode-coupled NMOS transistor 28 immediately after the power supply is turned on. At this point, the gate-source voltage VGS of the depression NMOS transistor 20 is directly clamped by a clamp circuit coupled between the gate and source, so that the gate-source voltage VGS can more effectively restricted than that in a configuration in which a clamping circuit is coupled between gate and ground potential. Thereby, according to the third embodiment of the present invention, the occurrence of rush current is prevented without regard to the output of the differential amplifier 22 to allow the depression NMOS transistor 20 to be safely operated.

In the regulator circuits according to the first to third embodiments, although the configuration is described in which the cut-off transistor, the substrate potential generation circuit, the phase compensation circuit, or the clamping circuit is added to the regulator circuit including the depression NMOS transistor being the output transistor and the differential amplifier, at least two circuits among the above circuits may be combined to be added to the regulator circuit.

The embodiments disclosed herein are exemplary in all respects and should not be considered to be limitative. The scope of the invention is indicated not by the description of the embodiment but by the claims, and embraces all changes within the meaning and range of equivalence of the claims.

What is claimed is:

1. A regulator circuit which converts a power supply voltage supplied from an input terminal and outputs a converted voltage to an output terminal, the regulator circuit comprising:

a depression-type NMOS transistor coupled between the input terminal and the output terminal;

a control circuit configured to compare an output voltage of the output terminal with a predetermined reference voltage and control a gate voltage of the depression-type NMOS transistor according to the comparison result so that the output voltage comes close to the reference voltage; and a clamping circuit coupled between the output terminal and a gate of the depression-type NMOS transistor so that the gate voltage of the depression-type NMOS transistor is within a predetermined voltage.

2. The regulator circuit according to claim 1, wherein the clamping circuit comprises a diode-coupled NMOS transistor.

3. The regulator circuit according to claim 1, wherein the clamping circuit comprises a diode-coupled PMOS transistor.

4. A regulator circuit which converts a power supply voltage supplied from an input terminal and outputs a converted voltage to an output terminal, the regulator circuit comprising:

a depression-type NMOS transistor coupled between the input terminal and the output terminal;

a control circuit configured to compare an output voltage of the output terminal with a predetermined reference voltage and control a gate voltage of the depression-type NMOS transistor according to the comparison result so that the output voltage comes close to the reference voltage; and a cut-off transistor configured to cut off a current path between the input terminal and the output terminal via the depression-type NMOS transistor.

* * * * *